US006775515B2

(12) United States Patent
Ouchi

(10) Patent No.: US 6,775,515 B2
(45) Date of Patent: Aug. 10, 2004

(54) SHEET TRANSPORTING DEVICE AND IMAGE FORMING APPARATUS

(75) Inventor: Akihiro Ouchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/375,092

(22) Filed: Feb. 28, 2003

(65) Prior Publication Data

US 2004/0052561 A1 Mar. 18, 2004

(30) Foreign Application Priority Data

Sep. 18, 2002 (JP) ..... P2002-271539

(51) Int. Cl.[7] ..... G03G 15/00
(52) U.S. Cl. ..... 399/393; 399/107; 399/124
(58) Field of Search ..... 279/9.11, 9.13; 399/124, 393, 394, 391, 395, 107

(56) References Cited

U.S. PATENT DOCUMENTS 5,785,308 A * 7/1998 Flores et al. ..... 271/9.11
6,049,346 A * 4/2000 Cho ..... 347/153

FOREIGN PATENT DOCUMENTS

JP 2001-2282 1/2001

* cited by examiner

*Primary Examiner*—Hoang Ngo
(74) *Attorney, Agent, or Firm*—Morgan, Lewis & Bockius LLP

(57) ABSTRACT

A sheet supplying unit of a sheet transporting device can be attached later to an image forming apparatus body. On a sheet transporting side of the sheet supplying unit, a protrusion is provided, and a second transporting member is disposed at this protrusion. A reception space is provided on the image forming apparatus body, and the protrusion is arranged protrusively in this reception space, whereby the second transporting member protrudes to the image forming apparatus body to shorten a length of a transporting passage between a first transporting member on the image forming apparatus body side and the second transporting member.

26 Claims, 4 Drawing Sheets

SHEET TRANSPORTING DEVICE AND IMAGE FORMING APPARATUS

The present disclosure relates to the subject matter contained in Japanese Patent Application No. 2002-271539 filed Sep. 18, 2002, which is incorporated herein by reference in its entirety.

BACKGROUND OF THE INVENTION

1. Field of the Invention

The present invention relates to a sheet transporting device for transporting a sheet and an electrophotographic type image forming apparatus having the sheet transporting device.

2. Description of the Related Art

As this type of image forming apparatus, an apparatus, in which a sheet transporting device can be attached later to an image forming apparatus body thereby to be constituted in a mode of user's desire, has been already known (refer to JP-A-2001-2282). The sheet transporting device has a transporting means comprising a pair of rolls for transporting a sheet, and a sheet is fed to the image forming apparatus body by the transporting means of this transporting device. In order to transport a short sheet such as a postcard by this sheet transporting device, it is necessary to shorten a length of a transporting passage between the transporting means. Conventionally, a transporting means for only transporting a sheet is arranged on the image forming apparatus body side, whereby the length of the transporting passage between the transporting means is made shorter than a length of a smallest original document such as a postcard. Further, in consideration of a case where the plural sheet transporting devices are superimposed, another transporting means that receives a sheet from another sheet transporting device and transports it is provided on the sheet transporting device thereby to secure a shorter length of transporting passage than a length of the smallest original document.

However, in the above conventional example, since the transporting means is necessarily provided on the image forming apparatus body or the sheet transporting device, in case where the transporting device is not provided more, this transporting means becomes unemployed parts. This causes useless increase of cost.

SUMMARY OF THE INVENTION

An object of the invention is to provide a sheet transporting device and an image forming apparatus in which a short length of a transporting passage is secured, useless parts are reduced, and cost can be reduced.

In order to achieve the object, according to a first aspect of the invention, there is provided a sheet transporting device being attachable to an apparatus body, comprising: a sheet supplying unit body having a joint surface joined to the apparatus body; and a transporting member of which at least a portion protrudes upward from the joint surface of the sheet supplying unit body. According to a second aspect of the invention, there is provided a sheet transporting device being attachable to an apparatus body, comprising: a sheet supplying unit body having a joint surface joined to the apparatus body; a protrusion that protrudes upward from the joint surface of this sheet supplying unit body; and a transporting member disposed on the protrusion, of which at least a portion protrudes from the joint surface of the sheet supplying unit body. Therefore, since the transporting member of the sheet transporting device is protruded upward from the joint surface, a length of a transporting passage between the apparatus body and the sheet transporting device is shortened. Further, since the transporting member is provided on the sheet transporting device, it is not necessary to provide the transporting member on the apparatus body side, so that the transporting member does not become useless in case that the sheet transporting device is not attached.

It is preferable that the above protrusion has a protection cover that covers at least the portion protruded from the sheet supplying unit body, of the transporting member. It is preferable that the protection cover is formed integrally with the sheet supplying unit body. Further, a transporting guide may be formed inside the protection cover thereby to be used as both protection of transporting member and guide of sheet. Further, the transporting member may comprise a pair of rolls. Further, it is preferable that the sheet transporting device is provided with a driving unit that drives the transporting member.

According to a third aspect of the invention, there is provided a sheet transporting device being attachable to an apparatus body, comprising: a first transporting unit including a first sheet supplying unit body having a first joint surface joined to the apparatus body, and a first transporting member of which at least a portion protrudes upward from the first joint surface of the first sheet supplying unit body; and a second transporting unit including a second sheet supplying unit body having a second joint surface joined to the first transporting unit, and a second transporting member of which at least a portion protrudes upward from the second joint surface of the second sheet supplying unit body. In the sheet transporting device thus constituted, plural transporting units are superimposed. In this case, since the second transporting member of the second transporting unit is protruded upward from the joint surface of the first transporting unit, a length of a transporting passage between the transporting units can be shortened. Further, since the second transporting member is provided on the second transporting unit, it is not necessary to provide a transporting member for receiving a sheet from the second transporting unit on the first transporting unit, so that the transporting member is not useless even in case that the second transporting unit is not attached.

Here, it is preferable that a length of a transporting passage between the first transporting member and the second transporting member is the same as or smaller than a length of a smallest transportable sheet. Further, each of the first transporting member and the second transporting member may comprise a pair of rolls, and their pairs of rolls use common parts, whereby cost can be reduced.

According to a fourth aspect of the invention, there is provided an image forming apparatus comprising: an image forming apparatus body; and a sheet transporting device being attachable to the image forming apparatus body, wherein the image forming apparatus body includes an image forming unit and a first transporting member that transports a sheet to the image forming unit, the sheet transporting device includes a sheet supplying unit body having a joint surface joined to the apparatus body, and a second transporting member of which at least a portion protrudes upward from the joint surface of the sheet supplying unit body, and at least the portion of the second transporting member of the sheet transporting device is arranged protrusively into a reception space formed at a lower portion of the image forming apparatus body. Further, according to a fifth aspect of the invention, there is provided an image forming apparatus comprising: an image forming apparatus body; and a sheet transporting device being attachable to the image forming apparatus body, wherein the image forming apparatus body includes an image forming unit, and a first transporting member that transports a sheet to the image forming unit, the sheet transporting device includes a sheet supplying unit body having a joint surface, a protrusion that protrudes upward from the joint surface, and a transporting member disposed on the protrusion, of which at least a portion protrudes from the joint surface of the sheet supplying unit body, and at least the portion of the second transporting member of the sheet transporting device is arranged protrusively into a reception space formed at a lower portion of the image forming apparatus body. Herein, it is preferable that a length of a transporting passage between the first transporting member and the second transporting member is the same as or smaller than a length of a smallest transportable sheet. Further, each of the first transporting member and the second transporting member may comprise a pair of rolls, and their pairs of rolls use common parts, whereby cost can be reduced. Further, it is preferable that a protection cover is provided on the protrusion and fitted into the image forming apparatus body. Since a portion of the sheet transporting device is arranged protrusively into a reception space, the height dimension of the sheet transporting device including the sheet supplying unit body can be suppressed. In other words, the sheet transporting device can contain more sheets compared with a conventional sheet transporting device having the same height dimension.

According to a sixth aspect of the invention, there is provided an image forming apparatus comprising: an image forming apparatus body; and a sheet transporting device being attachable to the image forming apparatus body, the image forming apparatus body includes an image forming unit, and a first transporting member that transports a sheet to the image forming unit, and the sheet transporting device includes a first sheet supplying unit body having a first joint surface joined to the image forming apparatus body, a first transporting unit having a second transporting member of which at least a portion protrudes upward from the first joint surface of the first sheet supplying unit body, a second sheet supplying unit body having a second joint surface joined to the first transporting unit, and a second transporting unit having a third transporting member of which at least a portion protrudes upward from the second joint surface of the second sheet supplying unit body. Herein, it is preferable that a length of a transporting passage between the first transporting member and the second transporting member, and a length of a transporting passage between the second transporting member and the third transporting member are respectively the same as or smaller than a length of a smallest transportable sheet. Further, each of the first transporting member, the second transporting member and the third transporting member may be constituted by a pair of rolls, and their pairs of rolls use common parts, whereby cost can be reduced.

According to a seventh aspect of the invention, there is provided an image forming apparatus to which a sheet transporting device is attachable, the image forming apparatus comprising: an image forming apparatus body having a joint surface jointed to the sheet transporting device, wherein a reception space for receiving a transporting member disposed on the sheet transporting device such that a portion of the transporting member protrudes upward from the joint surface of the image forming apparatus body is formed in the image forming apparatus body.

DETAILED DESCRIPTION OF THE PREFERRED EMBODIMENTS

An embodiment of the invention will be described with reference to drawings.

Figure 1:
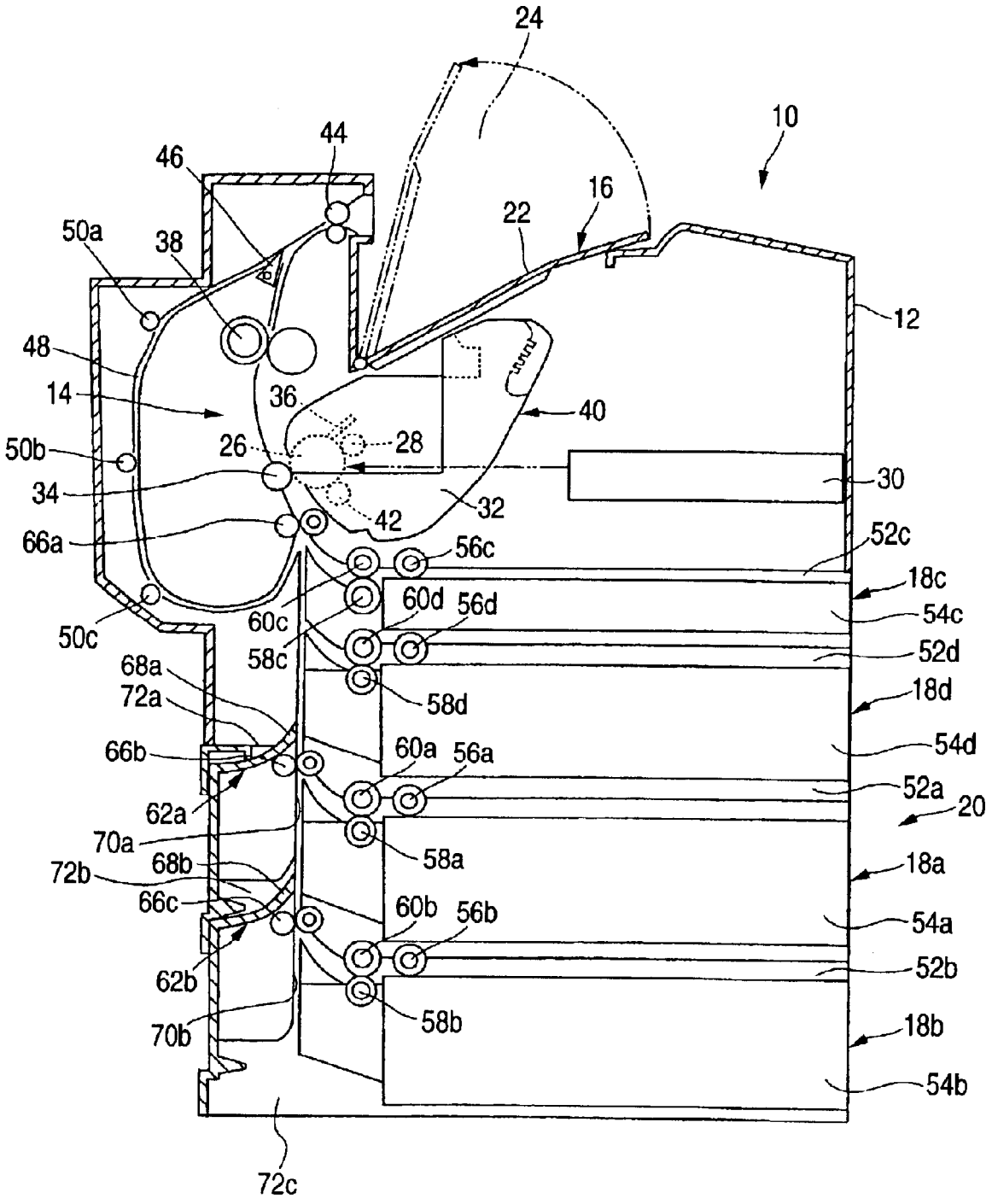
FIG. 1 is a sectional view showing an image forming apparatus according to an embodiment of the invention.

FIG. 1 shows an outline of an image forming apparatus according to an embodiment of the invention. An image forming apparatus 10 has an image forming apparatus body 12, an image forming unit 14 is mounted in this image forming apparatus body 12, an ejecting section 16 described later is provided at the upper portion of this image forming apparatus body 12, and two body side sheet supplying units 18*c*, 18*d* are arranged at the lower portion of this image forming apparatus body. Further, a sheet transporting device 20 that can be attached as an option is arranged on the lower side of the image forming apparatus body 12. This sheet transporting device 20 comprises, for example, a first sheet supply unit 18*a* and a second sheet supplying unit 18*b* that are superimposed in a two-step state.

The ejecting section 16 has a slant portion 22 that is rotatable with respect to the image forming apparatus body 12. This slant portion 22 slants so that its ejecting port is lower and its portion toward a front surface (to the right in FIG. 1) becomes gradually higher, whereby the ejecting port becomes a lower end and a high leading end becomes an upper end. This slant portion 22 is supported by the image forming apparatus body 12 rotatably about the lower end. As shown with a two-dot chain line in FIG. 1, when the slant portion 22 rotates upward and opens, an open portion 24 is formed, and a process cartridge40 described later can be attached and detached through this open portion 24.

The image forming unit 14, for example, of electrophotographic type, comprises an image carrier 26 composed of a photoconductor; a charger 28 composed of, for example, a charging roll that charges this image carrier 26 uniformly; an optical writing apparatus 30 that exposes the image carrier 26 charged by this charger 28 to light and forms a latent image on the image carrier 26; a developing apparatus 32 that makes visible the latent image formed on the image carrier 26 by this optical writing apparatus 30 with developer; a transfer apparatus 34 composed of, for example, a transfer roll, which transfers a developer image by this developing apparatus 3 onto a sheet; a cleaning apparatus 36 composed of, for example, a blade, which cleans the developer remaining on the image carrier 26; and a fixing apparatus 38 composed of, for example, a pressing roll and a heating roll, which fixes the developer image transferred on the sheet by the transfer apparatus 34 onto the sheet. The optical writing apparatus 30 is composed of, for example, a scanning type laser exposing apparatus, which is arranged in the vicinity of a front of the image forming apparatus body 12 in parallel to the sheet supplying units 18*a* to 18*d*, and exposes the image carrier 26 to light passing through the developing apparatus 32. Further, the developing apparatus 32 has a developing roll 42 opposed to the image carrier 26.

The process cartridge 40 is constituted by integrally forming the image carrier 26, the charger 28, the developing apparatus 32, and the cleaning apparatus 36. This process cartridge 40 is arranged immediately below the slant portion 22 of the ejecting section 16, and attached and detached through the open portion 24 formed when the slant portion 22 is open.

Further, in the image forming apparatus body 12, a first transporting means 66*a* that is, for example, a regist roll 42 is arranged on the upstream side (on the downward side in FIG. 1) of the transfer apparatus 34. A sheet transported from the sheet supplying unit 18*a* to 18*d* is temporarily stopped by this first transporting means 66*a*, fed to the image forming unit 14 at a predetermined timing to form an image, and ejected to the ejecting section 16 by a discharge roll 44.

However, in case of duplex print, the sheet on which the image has been formed is returned to a reversal passage. Namely, the passage before the discharge roll 44 is divided into two, a switching claw 46 is provided at its division point, and a reversal passage 48 on which the sheet is return from the division point to the regist roll 42 is formed. On this reversal passage 48, transporting rolls 50*a* to 50*c* are provided. In case of duplex print, the switching claw 46 is switched to a side where the reversal passage 48 is opened; and before a rear end of the sheet reaches the discharge roll 44, the discharge roll 44 reverses, so that a recording medium is guided to the reversal passage 48 and thereafter ejected through the first transporting means 66*a*, the transfer apparatus 34, the image carrier 26, and the fixing apparatus 38 to the ejecting section 16.

Each of the before-mentioned sheet supplying units 18*a* to 18*d* has a sheet supplying unit body 52*a* to 52*d* and a sheet supplying cassette 54*a* to 54*d* into which sheets are stored. The sheet supplying cassette 54*a* to 54*d* is attached slidably to the sheet supplying unit body 52*a* to 52*d*, and pulled out in a front direction (the right direction in FIG. 1) Further, at the upper portion at the back end of the sheet supplying cassette 54*a* to 54*d*, nudger roll 56*a* to 56*d* is arranged; and in front of this nudger roll 56*a* to 56*d*, a sheet supply retard roll 58*a* to 58*d* and a feed roll 60*a* to 60*d* are arranged. The nudger roll 56*a* to 56*d* and the feed roll 60*a* to 60*d* are rotatably supported by the sheet feeding unit body 54*a* to 54*d*, and the retard roll 58*a* to 58*d* is rotatably supported by the sheet supplying cassette 54*a* to 54*d*.

As described before, the first sheet supplying unit 18*a* can be attached to the image forming apparatus body 12 later, and the second sheet supplying unit 18*b* can be attached to the first sheet supplying unit 18*a* later. The first sheet supplying unit 18*a* and the second sheet supplying unit 18*b* have the same structure. Therefore, the first sheet supplying unit 18*a* will be described with reference to FIGS. 2 and 3, and explanation of the second sheet supplying unit 18*b* is omitted by denoting the same components regarding the sheet supplying cassette 18*b* in FIG. 1 as those regarding the sheet supplying cassette 18*a* in FIGS. 2 and 3 by the same reference numerals plus reference character b.

In the first sheet supplying unit 18*a*, a first protrusion 62*a* is provided at an upper portion on the sheet transporting side of the sheet supplying unit body 52*a*. This protrusion 62*a* protrudes upward of a joint surface 64 of the image forming apparatus body 12. For this first protrusion 62*a*, a second transporting means 66*b* comprising a pair of rolls is provided. This second transporting means 66*b* also protrudes upward of the joint surface of the image forming apparatus body 12. Further, a protection cover 68*a* is provided for the protrusion 62*a* so as to protect the outside of the second transporting means 66*b* so as to protect the second transporting means 66*b*. Since this protection cover 68*a* protects the second transporting means 66*b*, when the first sheet supplying unit 18*a* is superimposed to the image forming apparatus body 12, it is possible to prevent the first sheet supplying unit 66*a* from being damaged, and safety of a worker can be secured. Inside this protection cover 68*a*, a first guide 70*a* is formed protrusively like a rib to guide a sheet from the downstream to the first transporting means 66*a*. This protection cover 68*a* and the first guide 70*a* are formed integrally with the sheet supplying unit body 52*a*.

On the other hand, in an image forming apparatus body 12, a first reception space 72*a* corresponding to the first protrusion 62*a* is formed. In this first reception space 72*a*, the first protrusion 62*a* is arranged protrusively, whereby an upper surface portion of the sheet supplying unit body 52*a* is joined to the joint surface 64 of the image forming apparatus body 12. On the upper surface portion of the sheet supplying unit body 52*a*, plural projections 74 are formed, and they 74 are fitted into the image forming apparatus body 12, whereby the first sheet supplying unit body 52*a* is positioned to the image forming apparatus body 12. Further, the first protection cover 68*a* is fitted into the image forming apparatus body 12 at the upper portion of the first reception space. Though the image forming apparatus body 12 may be only placed on the first sheet supplying unit 18*a*, they may be fixed with screws.

Further, below the protrusion of the first sheet supplying unit body 52*a*, a second reception space 72*b* is formed. In this second reception space 72*b*, a second protrusion 62*b* of the second sheet supplying unit 18*b* is arranged protrusively, and a third sheet supplying unit 66*c* of the second sheet supplying unit 18*b* is joined to a joint surface (lower end surface) of the first sheet supplying unit body 52*a*. Further, below the protrusion of the second sheet supplying unit body 52*b*, a third reception space 72*c* is formed, into which a protrusion of a sheet supplying unit put under the second sheet supplying unit can be received.

A first drive motor 76*a* is provided inside a side surface of the first sheet supplying unit body 52*a*. This first drive motor 76*a* is coupled through a gear train 78 to the first nudger roll 56*a*, the first retard roll 58*a* and the second transporting means 66*b*, and drives these rolls on the basis of an instruction from the image forming apparatus body. In this embodiment, drive system of the sheet supplying unit is included in the unit body. Therefore, since drive transmission system is not divided, the drive transmission to each roll can be performed smoothly.

Reference numeral 80 is a connector for supplying electric power to the first drive motor 76*a*. Further, reference numeral 82 is a support plate for supporting the first nudger roll 56*a* and the first feed roll 58*a*, and is supported slidably by the first sheet supplying unit body 52*a*.

Each of the first transporting means 66*a*, the second transporting means 66*b* and the third transporting means 66*c* is composed of a drive roll and a driven roll, and the rolls of each unit use the same parts, so that cost can be reduced.

Figure 4:
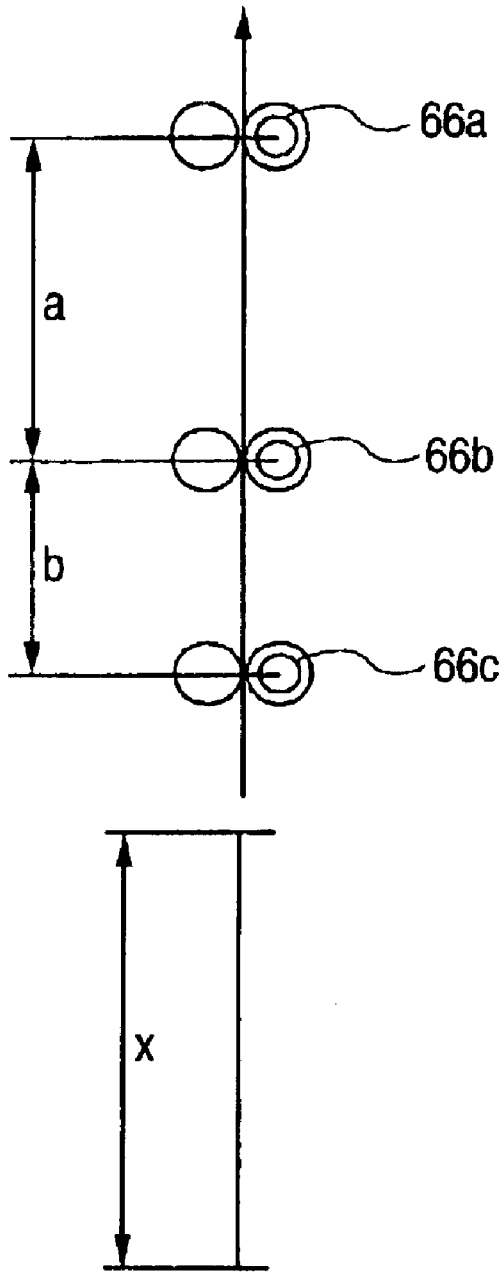
FIG. 4 is a side view showing a positional relation among a first transporting member to a third transporting member in the embodiment.

In FIG. 4, a positional relation among the first transporting means 66*a*, the second transporting means 66*b* and the third transporting means 66*c* is shown. Reference character a is a length of a transporting passage between the first transporting means 66*a* and the second transporting means 66*b*, and reference character b is a length of a transporting passage between the second transporting means 66*b* and the third transporting means 66*c*. Further, reference character X is a length of a smallest original document set in the image forming apparatus. This X, in case of a longitudinal side of a post card, is about 147 mm. Here, since the relation of A>a≧b is formed, the original sheet can be smoothly transported. This can be realized by protruding the second transporting means 66*b* and the third transporting means 66*c* into the image forming apparatus body 12 or the first sheet supplying unit 18*a* thereby shorten the lengths of the transporting passages a and b.

Next, operation of the above embodiment will be described.

The image carrier 26 is charged uniformly by the charger 28, this charged image carrier 26 is irradiated with a light issued from the optical writing apparatus 30 on the basis of the image signal, and a latent image is formed. The latent image on the image carrier 26 formed by this optical writing apparatus 30 is made visible by the developer in the developing apparatus 32.

On the other hand, one of the sheet supplying units 18*a* to 18*d* is selected according to a size signal, a sheet stored in one of the sheet supplying cassettes 54*a* to 54*d* is fed out by the nudger roll 56*a* to 56*d*. Next, the sheet is fanned by the retard roll 58*a* to 58*d* and the feed roll 60*a* to 60*d*, reaches to the first transporting means 66*a*, is stopped temporarily by this first transporting means 66*a*, and guided between the transfer apparatus 36 and the image carrier 26 with a timing.

When the recording medium is thus guided between the transfer apparatus 36 and the image carrier 26, the developer on the image carrier 26 is transferred onto the recording medium by the transfer apparatus 36. The sheet on which this developer has been transferred is ejected through the fixing apparatus 38 to the ejecting section 16.

For example, it is assumed that a post card is set in the second sheet supplying cassette 54*b* in the longitudinal direction, and a user selects a longitudinal side of the postcard or the second sheet supplying cassette 54*b*. Then, the postcard is fed out from the second sheet supplying cassette 54*b* by the second nudger roll 56*b*, fanned by the second retard roll 58*b* and the second feed roll 60*b*, and guided to the first sheet supplying unit 18*a* by the third transporting means 66*c* while being guided by the second guide 70*b*. The sheet transported by this first sheet supplying unit 18 is, while being guided by the first guide 70*a*, transported to the second transporting means 66*b*. Further, the sheet transported to this second transporting means 66*b* is transported to the first transporting means 66*a* in the image forming apparatus body 12 by the second transporting means 66*b*, so that the sheet, even if it is a postcard, can be smoothly transported without paper jam.

Figure 2:
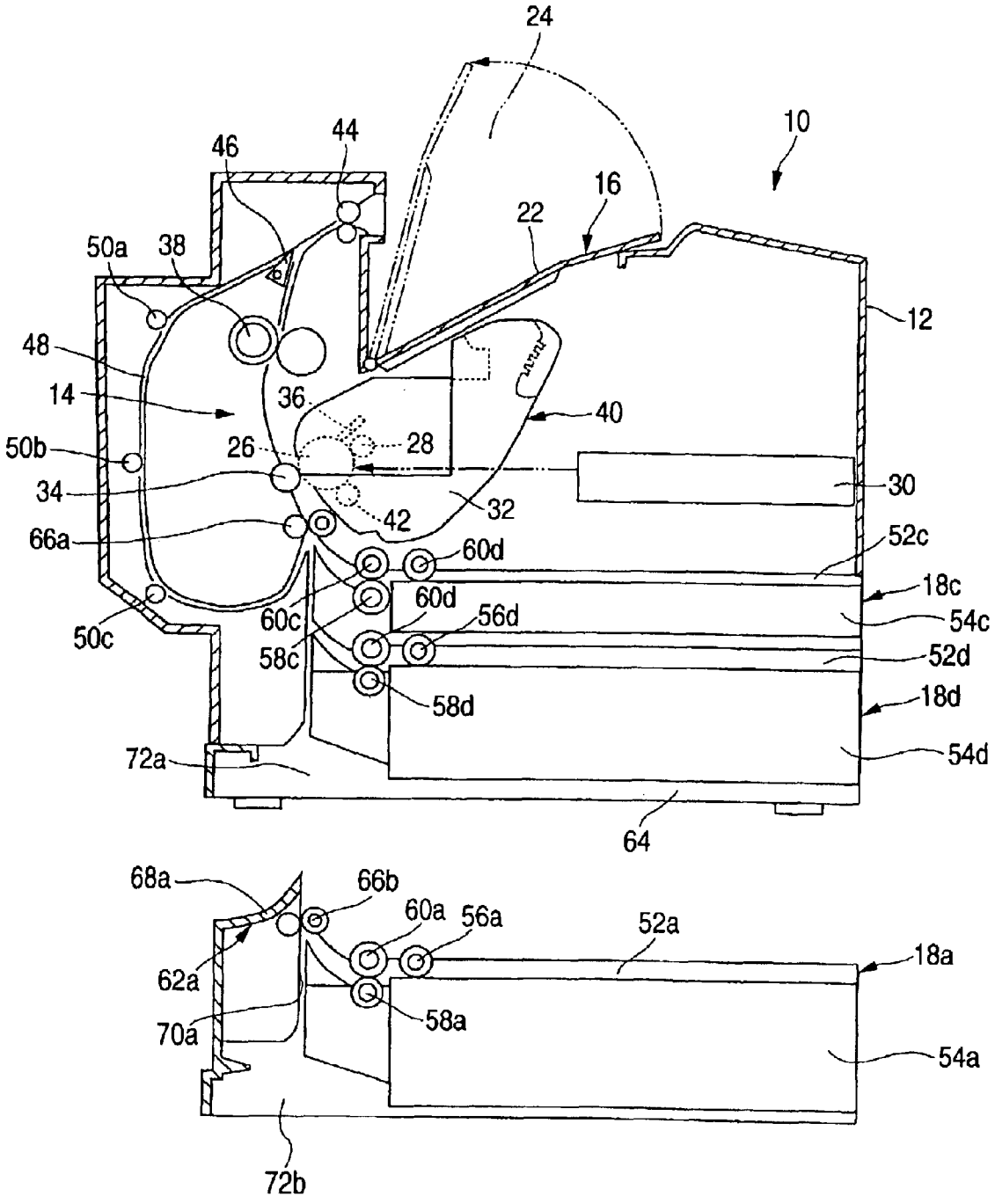
FIG. 2 is a sectional view showing a state where a first sheet supplying unit is detached from the image forming apparatus body in the image forming apparatus.
Figure 3:
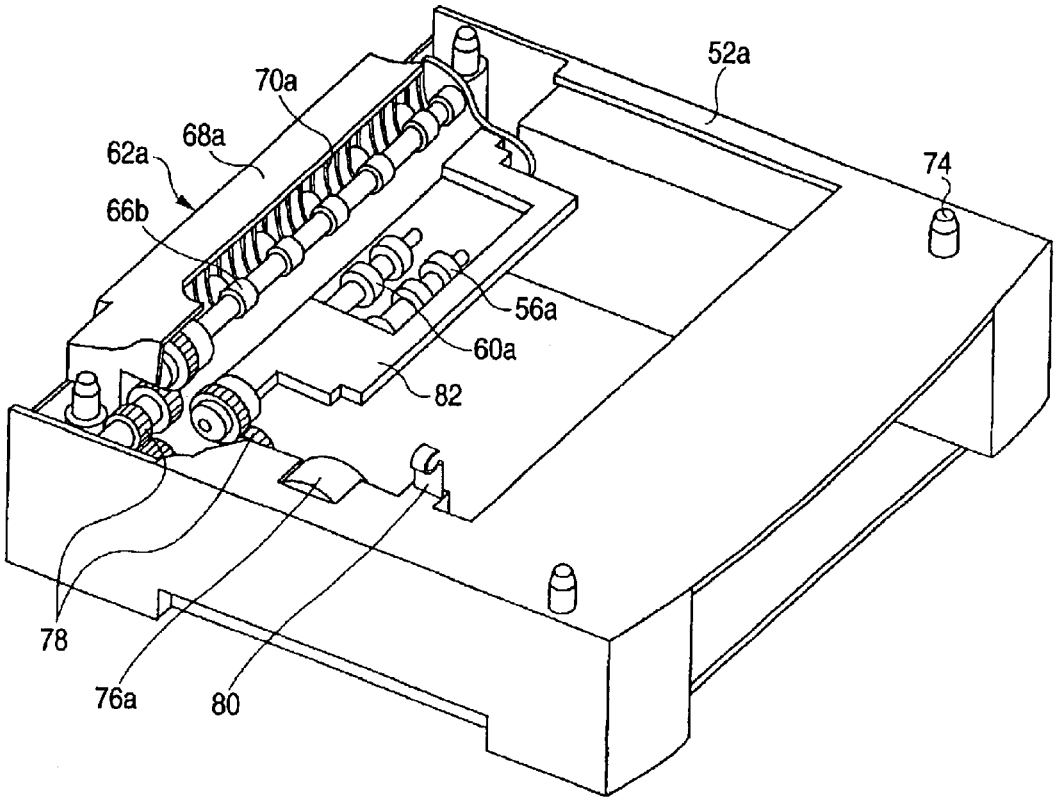
FIG. 3 is a perspective view showing a sheet supplying unit from which a sheet supplying cassette is removed in the embodiment.

As shown in FIG. 2, the sheet transporting device 20 including the first sheet supplying unit 18*a* and the second sheet supplying unit 18*b* can be selectively detached from the image forming apparatus body 12. For example, in case that both the first sheet supplying unit 18*a* and the second sheet supplying unit 18*b* have been detached, a sheet can be selected from two of the third sheet supplying unit 18*c* and the fourth sheet supplying unit 18*d* in the image forming apparatus. In this case, the second transporting means 66*b* of the first sheet supplying unit 18*a* is detached from the image forming apparatus 12 together with the first sheet supplying unit 18*a*. Therefore, the second transporting means 66*b* does not remain in the image forming apparatus body 12, so that it does not become the unemployed parts.

In the above embodiment, though the two sheet supplying units 18*c* and 18*d* are provided for the image forming apparatus body 12, they can be omitted. Further, the sheet transporting device 20 is not limited to the two superimposed sheet supplying units but may be a single, or three and more. Further, the sheet transporting device is not limited to the image forming apparatus but may be applied to another apparatus.

As described above, according to the invention, the transporting means of the sheet transporting device is provided so as to protrude onto the apparatus body or the sheet supplying unit side. Therefore, the short transporting passage is secured, and the unemployed parts can be reduced, whereby cost can be reduced.

What is claimed is:

1. A sheet transporting device being attachable to an apparatus body, comprising:

a sheet supplying unit body having a joint surface disposed along a longitudinal axis of the sheet supplying unit body, the joint surface joined to the apparatus body; and a transporting member, wherein at least a part of the transporting member protrudes upward from the joint surface of the sheet supplying unit body.

2. A sheet transporting device being attachable to an apparatus body, comprising:

a sheet supplying unit body having a joint surface disposed along a longitudinal axis of the sheet supplying unit body, the joint surface joined to the apparatus body;

a protrusion protruding upward from the joint surface of the sheet supplying unit body; and a transporting member disposed on the protrusion, wherein at least a portion of the transporting member protrudes from the joint surface of the sheet supplying unit body.

3. The sheet transporting device according to claim 2, wherein the protrusion has a protection cover that covers at least the portion protruded from the sheet supplying unit body, of the transporting member.

4. The sheet transporting device according to claim 3, wherein a transporting guide is formed inside the protection cover.

5. The sheet transporting device according to claim 2, wherein the protection cover is formed integrally with the sheet supplying unit body.

6. The sheet transporting device according to claim 1, wherein the transporting member comprises a pair of rolls.

7. The sheet transporting device according to claim 1, further comprising a driving unit for driving the transporting member.

8. A sheet transporting device being attachable to an apparatus body, comprising:

a first transporting unit including a first sheet supplying unit body having a first joint surface disposed along a longitudinal axis of the first sheet supplying unit body, the first joint surface joined to the apparatus body, and a first transporting member of which at least a portion protrudes upward from the first joint surface of the first sheet supplying unit body; and a second transporting unit including a second sheet supplying unit body having a second joint surface joined to the first transporting unit, and a second transporting member of which at least a portion protrudes upward from the second joint surface of the second sheet supplying unit body.

9. The sheet transporting device according to claim 8, wherein a length of a transporting passage between the first transporting member and the second transporting member is the same as or smaller than a length of a smallest transportable sheet.

10. The sheet transporting device according to claim 8, wherein each of the first transporting member and the second transporting member comprises a pair of rolls, and the pairs of rolls have common parts.

11. An image forming apparatus comprising:

an image forming apparatus body; and a sheet transporting device being attachable to the image forming apparatus body, wherein the image forming apparatus body includes an image forming unit, and a first transporting member that transports a sheet to the image forming unit, the sheet transporting device includes a sheet supplying unit body having a joint surface disposed along a longitudinal axis of the sheet supplying unit body, the joint surface joined to the image forming apparatus body, and a second transporting member of which at least a portion protrudes upward from the joint surface of the sheet supplying unit body, and at least the portion of the second transporting member of the sheet transporting device is arranged protrusively in a reception space formed at a lower portion of the image forming apparatus body.

12. The image forming apparatus according to claim 11, wherein a length of a transporting passage between the first transporting member and the second transporting member is the same as or smaller than a length of a smallest transportable sheet.

13. The image forming apparatus according to claim 11, wherein each of the first transporting member and the second transporting member comprises a pair of rolls, and the pairs of rolls have common parts.

14. An image forming apparatus comprising:

an image forming apparatus body; and a sheet transporting device being attachable to the image forming apparatus body, wherein the image forming apparatus body includes an image forming unit, and a first transporting member that transports a sheet to the image forming unit, the sheet transporting device includes a sheet supplying unit body having a joint surface disposed along a longitudinal axis of the sheet supplying unit body, the joint surface joined to the image forming apparatus body, a protrusion projecting upward from the joint surface of the sheet supplying unit body, and a second transporting member disposed on the projection, at least a portion of the second transporting member protrudes upward from the joint surface of the sheet supplying unit body, and at least the portion of the second transporting member is arranged protrusively in a reception space formed at a lower portion of the image forming apparatus body.

15. The image forming apparatus according to claim 14, wherein the protrusion is formed integrally with the sheet supplying unit body.

16. The image forming apparatus according to claim 14, wherein the protrusion has a protection cover that covers at least the portion protruded from the sheet supplying unit body, of the transporting member.

17. The image forming apparatus according to claim 16, wherein a transporting guide is formed inside the protection cover.

18. The image forming apparatus according to claim 16, wherein the protection cover is fitted into the image forming apparatus body.

19. An image forming apparatus comprising:

an image forming apparatus body; and a sheet transporting device being attachable to the image forming apparatus body, wherein the image forming apparatus body includes an image forming unit, and a first transporting member that transports a sheet to the image forming unit; and the sheet transporting device includes a first sheet supplying unit body having a first joint surface disposed along a longitudinal axis of the first sheet supplying unit body, the first joint surface joined to the image forming apparatus body, a first transporting unit having a second transporting member of which at least a portion protrudes upward from the first joint surface of the first sheet supplying unit body, a second sheet supplying unit body having a second joint surface joined to the first transporting unit, and a second transporting unit having a third transporting member of which at least a portion protrudes upward from the second joint surface of the second sheet supplying unit body.

20. The image forming apparatus according to claim 19, wherein a length of a transporting passage between the first transporting member and the second transporting member, and a length of a transporting passage between the second transporting member and the third transporting member are respectively the same as or smaller than a length of a smallest transportable sheet.

21. The image forming apparatus according to claim 19, wherein each of the first transporting member, the second transporting member, and the third transporting member comprises a pair of rolls, and the pairs of rolls have common parts.

22. An image forming apparatus to which a sheet transporting device is attachable, the image forming apparatus comprising:

an image forming apparatus body having a joint surface disposed along a longitudinal axis of the image forming apparatus body, the joint surface jointed to the sheet transporting device, wherein a reception space for receiving a transporting member disposed on the sheet transporting device such that a portion of the transporting member protrudes upward from the joint surface of the image forming apparatus body is formed in the image forming apparatus body.

23. The sheet transporting device according to claim 6, further comprising a sheet supplying cassette slidably engaged with the sheet supplying unit body, wherein the pair of rolls is provided on the sheet supplying unit body.

24. The sheet transporting device according to claim 10, further comprising:

a first sheet supplying cassette slidably engaged with the first sheet supplying unit body; and a second sheet supplying cassette slidably engaged with the second sheet supplying unit body, wherein the pairs of rolls are provided on the first sheet supplying unit body and the second sheet supplying unit body, respectively.

25. The image forming apparatus according to claim 13, further comprising:

a sheet supplying cassette slidably engaged with the sheet supplying unit body, wherein the pairs of rolls are provided on the image forming apparatus body and the sheet supplying unit body, respectively.

26. The image forming apparatus according to claim 21, further comprising:

a first sheet supplying cassette slidably engaged with the first sheet supplying unit body; and a second sheet supplying cassette slidably engaged with the second sheet supplying unit body, wherein the pairs of rolls are provided on the image forming apparatus body, the first sheet supplying unit body, and the second sheet supplying unit body, respectively.

* * * * *